US005948523A

United States Patent [19]

Carpenter et al.

[11] Patent Number: 5,948,523

[45] Date of Patent: Sep. 7, 1999

[54] TOOL FOR COLDFORMING OPERATIONS

[75] Inventors: Michael John Carpenter, Nuneation; Gary William Sweetman, Coventry, both of United Kingdom

[73] Assignee: Sandvik AB, Sandviken, Sweden

[21] Appl. No.: 08/895,907

[22] Filed: Jul. 17, 1997

[30] Foreign Application Priority Data

Jul. 19, 1996 [SE] Sweden ..... 9602814

[51] Int. Cl.[6] ..... C22C 29/02

[52] U.S. Cl. ..... 428/325; 428/457; 428/469; 428/472; 428/698; 428/704; 51/295; 51/307; 51/309; 407/119; 75/238; 75/243; 75/244; 427/444

[58] Field of Search ..... 428/704, 698, 428/469, 325, 457, 472; 407/119; 75/238, 243, 244; 427/444; 51/295, 307, 309

[56] References Cited

U.S. PATENT DOCUMENTS

| | | | |
|---|---|---|---|
| 3,915,757 | 10/1975 | Engel | 148/6 |
| 3,959,092 | 5/1976 | Komatsu et al. | 204/39 |
| 4,236,926 | 12/1980 | Lindholm et al. | 75/238 |
| 4,404,045 | 9/1983 | Thevenot et al. | 148/31.5 |
| 4,961,780 | 10/1990 | Pennington, Jr. | 75/238 |
| 5,116,416 | 5/1992 | Knox et al. | 75/238 |

*Primary Examiner*—Archene Turner
*Attorney, Agent, or Firm*—Burns, Doane, Swecker & Mathis, L.L.P.

[57] ABSTRACT

An improved coldforming tool made of a zone in a tungsten carbide-cobalt cemented carbide is disclosed. The tool, preferably a wire drawing nib, contains WC with a mean grain size of 1.5–2 $\mu$m and 5–7 weight % Co and with a carbon content close to saturation level and sufficient to exhibit cobalt magnetic measurements of 92%–98% of that of pure cobalt.

5 Claims, 2 Drawing Sheets

TOOL FOR COLDFORMING OPERATIONS

BACKGROUND OF THE INVENTION

The present invention relates to a tool for coldforming operations.

Cemented carbide products are used in tools for different coldforming operations of materials like steels, copper alloys, composite materials, etc. Examples of such tools are wire drawing dies, which are a cemented carbide nib shrink fit into a steel holder. Such tools should have a hard and wear resistant surface zone which also should have the following additional properties: good thermal conductivity; low coefficient of friction, i.e., it may be self lubricating or assist lubrication with a coolant; good corrosion resistance; resistance to microcracking; and high toughness.

When using cemented carbides in tools for the forming of, e.g., copper or its alloys, chemical reactions may occur between the binder metal of the hard metal and the copper rich alloy. In order to minimize the effects of chemical wear of the cobalt binder phase and to improve the wear resistance, a cobalt (binder) content of about 3% and a grain size of <1 $\mu$m is used in hard metals for such applications. Often, a low carbon content close to eta phase formation is chosen. In order to maintain the fine grain size, grain growth inhibitors such as VC, $Cr_3C_2$, etc., are used.

In order to further increase the wear resistance, the surface of the tool exposed to wear is often boronized. The boronizing treatment is itself known to the skilled artisan and is generally done by applying a paste of organic or inorganic material containing a boron compound such as boron metal, BN, $B_4C$, etc., on the wear surfaces of the tool and heat treating the coated tool in an argon atmosphere at 800°–1100° C. During this treatment, a thin gradient zone is induced into the surface zone of the hard metal tool. This zone is depleted with cobalt and also contains a boron rich phase which forms during the treatment. This makes the surface zone harder, tougher and more resistant to thermal cracking. As a result, this treatment offers an improved combination of hardness and toughness and thus increased wear resistance. This effect can also be reapplied as the surface layer is eroded. The worn surface layer of the tool is then repolished. A boron-containing paste is applied and heat treated. A tool can typically be retreated several times before it loses its internal bore geometry and the tool becomes unusable. This is the life determining factor of such a tool.

OBJECTS AND SUMMARY OF THE INVENTION

It is an object of this invention to avoid or alleviate the problems of the prior art.

It is further an object of this invention to provide a tool for coldforming operations with a further improved combination of high hardness and toughness and, thus, increased wear resistance.

In one aspect of the invention there is provided a cemented carbide tool with a boronized surface zone for coldforming operations wherein the cemented carbide comprises WC with a mean grain size of 1.5–2 $\mu$m and 5–7 weight % Co with a carbon content close to saturation level and sufficient to exhibit cobalt magnetic measurements of 92%–98% of the cobalt magnetic measurement of pure cobalt.

In another aspect of the invention there is provided a process of coldforming metal using a cemented carbide tool, the improvement comprising using as the cemented carbide tool, a cemented carbide tool with a boronized surface zone wherein the cemented carbide comprises WC with a mean grain size of 1.5–2 $\mu$m and 5–7 weight % Co with a carbon content close to saturation level and sufficient to exhibit cobalt magnetic measurements of 92%–98% of the cobalt magnetic measurement of pure cobalt.

DETAILED DESCRIPTION OF THE PREFERRED EMBODIMENTS OF THE INVENTION

It has now surprisingly been found that a tool for coldforming operations with an increased performance of about three times increased lifetime than prior art tools can be obtained if the tool is made of a cemented carbide comprising WC with a mean grain size of 1.5–2 $\mu$m and 5–7 weight %, preferably about 6 weight %, Co and with the carbon content close to saturation level with respect to precipitation of graphite, and sufficient for the tool to exhibit a cobalt magnetic measurement ("CoM") of 92%–98% of the cobalt magnetic measurement of pure cobalt. Such magnetic measurements can be made in accordance with known techniques. Cobalt magnetic measurement is made on the whole body of the tool before boronizing using known techniques: using magnetic saturation equipment which specifically measures maximum magnetic induction. The CoM value is essentially unaffected by the boronizing treatment and CoM determination is a routine method for quality control of cemented carbide. It should be noted that certain elements other than cobalt (e.g., Cr) can influence magnetic moment and the CoM is relative to a particular grade composition. The tool is boronized using the prior art method. Of course, it can be retreated with boron or boron compounds as before.

The present invention also relates to the use in coldforming operations of a tool of a cemented carbide with a boronized surface zone comprising WC with a mean grain size of 1.5–2 $\mu$m and 5–7 weight %, preferably about 6 weight %, Co and with a carbon content close to saturation level, and sufficient for the tool to exhibit a cobalt magnetic measurement of 92%–98% of the cobalt magnetic measurement of pure cobalt.

Figure 2:
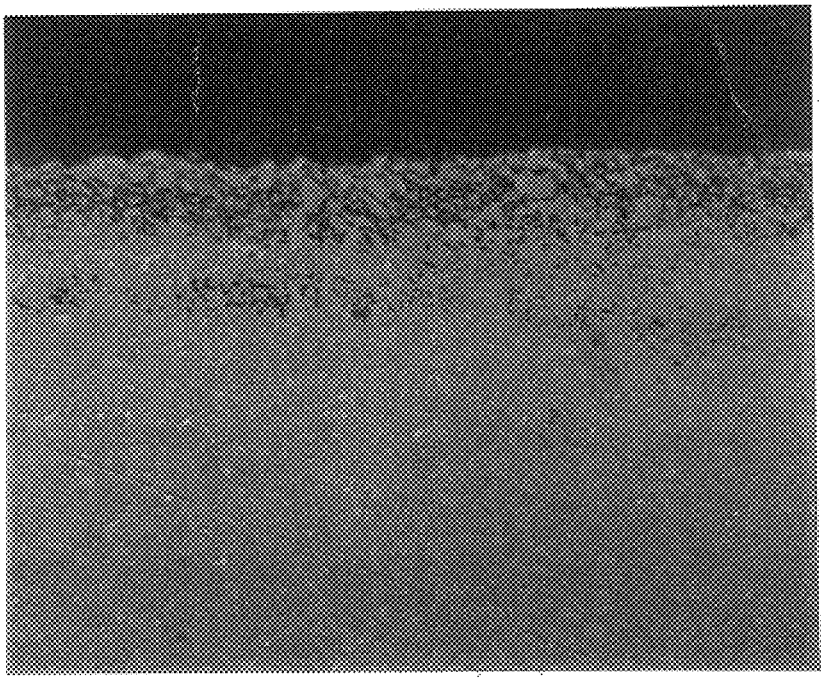
FIG. 2 shows in 1500× magnification the boronized surface zone of a prior art nib.
Figure 3:
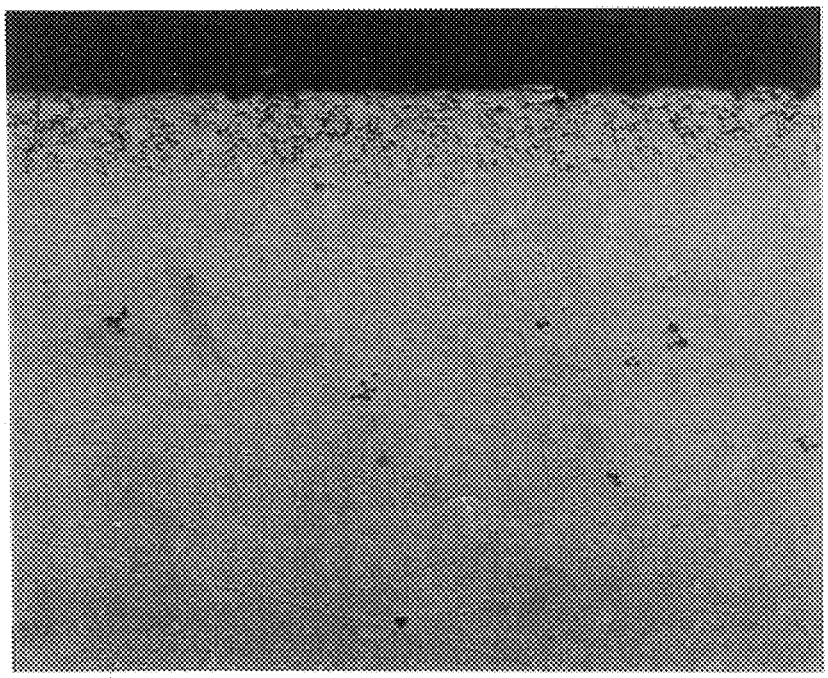
FIG. 3 shows in 1500× magnification the boronized surface zone of a nib according to the present invention.

The reason for the unexpected great improvement is not completely understood. Although we do not wish to be bound by any particular theory, it is believed that it is due to the combination of the increased hardness of the surface zone in combination with a substrate beneath having high toughness. The surface zone has a gradient created by a carbon-cobalt push in the solid state at 800°–1100° C. due to the boronizing treatment leaving a surface zone with an increased volume of hard phase, lower binder phase and improved surface condition with respect to coefficient of friction and resistance to micro-cracking at the working surface. In addition, a tougher zone of increased cobalt content is created beneath the surface zone which adds increased toughness to the tool. Compare FIGS. 2 and 3.

The invention is additionally illustrated in connection with the following Example which is to be considered as illustrative of the present invention. It should be understood, however, that the invention is not limited to the specific details of the Example.

EXAMPLE

Figure 1:
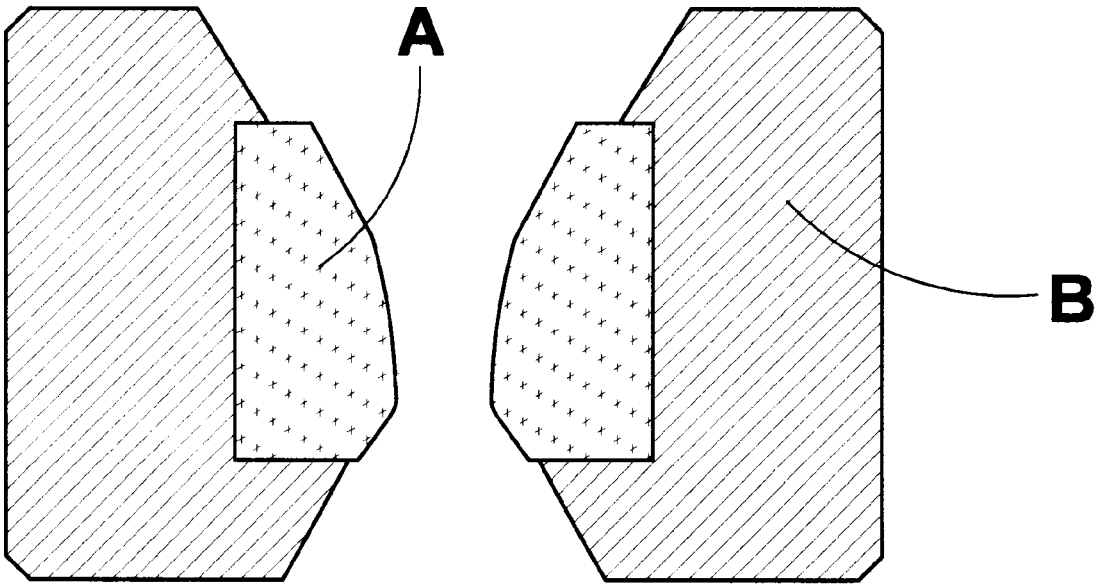
FIG. 1 shows a drawing die in which A=cemented carbide nib and B=steel casing.

Steel wire drawing dies according to FIG. 1 were manufactured according to the following:

A. WC-3% Co, submicron WC grain size, VC as grain growth inhibitor, prior art, FIG. 2, CoM of 90% (2.7/3.0)

B. WC-6% Co, WC grain size 1.5–2 μm, low carbon content, CoM 78% (4.7/6.0)

C. WC-6% Co, WC grain size 1.5–2 μm, medium carbon content, CoM 88% (5.3/6.0)

D. WC-6% Co, WC grain size 1.5–2 μm, high carbon content, FIG. 3, CoM 95% (5.7/6.0)

E. WC-6% Co, WC grain size 2–3.5 μm, high carbon content, CoM 97% (5.8/6.0)

F. WC-6% Co, submicron WC grain size with chromium carbide grain growth inhibitor, CoM 87% (5.2/6.0)

G. WC-6%Co, WC grain size 1.5–2 μm, with chromium carbide, CoM 90% (5.4/6.0)

The tools were tested in the wire drawing of steel chord with the following results. Performance factor relates to the quantity of product (wire) obtained as length of mass drawn through the different nibs relative to the prior art nib, A.

| | | Performance Factor |
|---|---|---|
| A. | prior art | 1 |
| B. | outside the invention | 0.2 |
| C. | outside the invention | 0.25 |
| D. | according to the invention | 3 |
| E. | outside the invention | 0.25 |
| F. | outside the invention | 0.2 |
| G. | outside the invention | 0.2 |

It is obvious from the Example that the unexpected properties can only be obtained with the chosen Co-content, WC grain size and carbon level.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A cemented carbide coldforming tool with a boronized surface zone for metal coldforming operations wherein the cemented carbide comprises WC with a mean grain size of 1.5–2 μm and 5–7 weight % Co with a carbon content close to saturation level and sufficient to exhibit cobalt magnetic measurements of 92%–98% of the cobalt magnetic measurement of pure cobalt.

2. The cemented carbide tool of claim 1 wherein the Co content is about 6 weight %.

3. In a process of coldforming metal using a cemented carbide tool, the improvement comprising using as the cemented carbide tool, a cemented carbide tool with a boronized surface zone wherein the cemented carbide comprises WC with a mean grain size of 1.5–2 μm and 5–7 weight % Co with a carbon content close to saturation level and sufficient to exhibit cobalt magnetic measurements of 92%–98% of the cobalt magnetic measurement of pure cobalt.

4. The process of claim 3 wherein the Co content of the cemented carbide tool is about 6 weight %.

5. The process of claim 3 wherein the tool is a wire drawing nib.

* * * * *